United States Patent [19]

Alexander et al.

[11] 4,176,075

[45] Nov. 27, 1979

[54] DIOXIME AND HYDROXY BENZOIC ACID METAL SALT ANTIOXIDANTS FOR LITHIUM SOAP GREASE COMPOSITIONS

[75] Inventors: A. Gordon Alexander; Keith Coupland, both of Sarnia, Canada

[73] Assignee: Exxon Research & Engineering Co., Florham Park, N.J.

[21] Appl. No.: 941,859

[22] Filed: Sep. 13, 1978

[51] Int. Cl.[2] ..... C10M 5/20; C10M 7/32; C10M 7/30; C10M 5/14

[52] U.S. Cl. ..... 252/42.1; 252/49.7; 252/51.5R; 252/400 R

[58] Field of Search ..... 252/42.1, 49.7, 51.5 R, 252/400 R

[56] References Cited

U.S. PATENT DOCUMENTS

| | | | |
|---|---|---|---|
| 2,208,162 | 7/1940 | Prutton et al. | 252/48 |
| 2,226,427 | 12/1940 | George et al. | 252/51 |
| 2,336,598 | 12/1943 | Downing et al. | 44/73 |
| 2,387,323 | 10/1945 | Gaynor et al. | 252/51.5 |
| 2,400,876 | 5/1946 | Daskais et al. | 260/566 |
| 2,497,061 | 2/1950 | Kellog | 99/163 |
| 2,951,808 | 9/1960 | Norton et al. | 252/18 |
| 3,711,407 | 1/1973 | Plumstead | 252/41 |
| 3,791,973 | 2/1974 | Gilani et al. | 252/41 |
| 3,929,651 | 12/1975 | Murray et al. | 252/41 |

*Primary Examiner*—Irving Vaughn
*Attorney, Agent, or Firm*—Eugene Zagarella, Jr.

[57] ABSTRACT

A high temperature grease composition with excellent oxidation stability comprises a major proportion of a lubricating oil, a thickener system which includes a lithium soap of a $C_{12}$ to $C_{24}$ hydroxy fatty acid and an antioxidant system which comprises an alkali metal salt of hydroxy benzoic acid and a selected dioxime compound.

14 Claims, No Drawings

DIOXIME AND HYDROXY BENZOIC ACID METAL SALT ANTIOXIDANTS FOR LITHIUM SOAP GREASE COMPOSITIONS

BACKGROUND OF THE INVENTION

This invention concerns a lithium soap grease of premium quality with outstanding high temperature and oxidation stability properties.

Lithium greases have been known and widely used for many years. The principal advantages of lithium greases have been high dropping points, good water resistance and ease of dispersion of the soaps in all types of lubricating oil base stocks. While the lithium soaps that are used as thickening agents for these greases can be prepared by reaction of lithium hydroxide or other lithium base with conventional high molecular weight fatty acids, lithium hydroxy stearate and the lithium soaps of related hydroxy fatty acids have been particularly useful because of their great mechanical stability.

Among the various lithium grease formulations which have been disclosed are a grease thickened with the combination of a lithium soap of a $C_{12}$ to $C_{24}$ hydroxy fatty acid and a lithium soap of a $C_2$ to $C_{12}$ aliphatic dicarboxylic acid as disclosed in U.S. Pat. Nos. 3,681,242 and 3,791,973; a grease with a thickener system comprising a combination of a monolithium salt of boric acid and a lithium soap of $C_{12}$ to $C_{24}$ hydroxy fatty acid as disclosed in U.S. Pat. No. 3,758,407; a grease composition comprising a lithium soap derived from a fatty acid containing an epoxy group and/or ethylenic unsaturation and a dilithium soap derived from a straight chain dicarboxylic acid as shown in U.S. Pat. No. 3,985,662; and a grease composition with a thickener system comprising a combination of a dilithium salt of a $C_4$–$C_{12}$ dicarboxylic acid, a lithium soap of $C_{12}$ to $C_{24}$ hydroxy fatty acid and a lithium salt formed in situ from a hydroxy carboxylic acid as disclosed in U.S. Pat. No. 3,929,651.

A variety of antioxidants have been used in lubricating oils over the years as shown, for example, in U.S. Pat. No. 3,785,977 wherein diarylamines, thiodarylamines and s-triazines are among the antioxidants disclosed; in U.S. Pat. No. 3,671,434 wherein quinone phosphates are disclosed as oxidation and corrosion inhibitor; in U.S. Pat. No. 3,642,632 wherein esters of anthranilic acid are disclosed as oxidation and corrosion inhibitors and in U.S. Pat. No. 2,226,427 wherein selected metal derivatives of glyoximes, particularly nickel, cobalt and iron are disclosed as antioxidants.

Many of the antioxidants which are effective in lubricating oils have been found to be undesirable for use in grease compositions since they tend to detrimentally effect the quality of the grease such as by softening the grease composition or by destroying or breaking down the grease structure. One known antioxidant which is particularly effective for relatively high temperature greases is the alkali metal salts of a hydroxy aromatic acid such as dilithium salicylate as disclosed in U.S. Pat. Nos. 2,951,808 and 3,711,407. However, the use of such antioxidants in grease compositions even at higher concentrations, offers limited life at the higher temperatures of about 350° F. or more and there is generally a need for frequent relubrication.

DESCRIPTION OF THE INVENTION

Now it has been found that a grease composition in accordance with this invention which comprises a major proportion of lubricating oil, a thickener system which includes a lithium soap of a $C_{12}$ to $C_{24}$ hydroxy fatty acid and an antioxidant system which comprises the combination of a selected dioxime compound and an alkali metal salt of hydroxy benzoic acid has significant and surprisingly improved grease life at the higher temperatures.

The dioxime compounds useful in the antioxidant combination of this invention have one of the following general formulas:

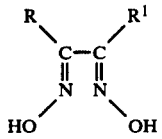

(I)

or

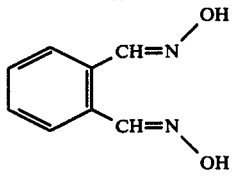

(II)

where R and R′ represent independently selected alkyl groups of 1 to 12 and preferably 1 to 4 carbon atoms. The alkyl groups as defined above may be straight or branched chain and the aromatic dioxime of formula II may include other substituents on the ring and particularly one or more alkyl groups. Other useful dioximes are the alkali metal salts of either of the above type structures such as lithium, sodium and potassium with lithium being particularly preferred.

The alkali metal salts of hydroxy benzoic acid which are part of the antioxidant combination of this invention are the mono- and disubstituted metal salts of a hydroxy aromatic acid of the general formula:

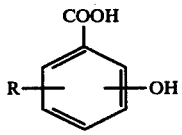

wherein R is hydrogen or an alkyl group of 1 to 12 carbon atoms. Useful alkali metals include lithium, sodium and potassium with lithium being particularly preferred. Preferred R groups in the above-noted hydroxy aromatic acid is hydrogen or alkyl of 1 to 4 carbon atoms. Salts of the ortho hydroxy are preferred and it is contemplated that other substituents on the aromatic ring or alkyl group may be further substituted on the hydroxy aromatic acid if they do not affect the antioxidant properties of the salt. Examples of the above salts are monolithium salicylate, dilithium salicylate, disodium salicylate, monosodium 2-hydroxy-5-tert. butyl benzoate, monolithium para-hydroxy benzoate and dilithium metahydroxy benzoate. Dilithium salicylate is a particularly preferred salt.

The hydroxy fatty acid employed in the greases of this invention will have from 12 to 24 and more usually 16 to 20 carbon atoms, and will preferably be a hydroxystearic acid, e.g., 9-hydroxy, 10-hydroxy or 12-hydroxystearic acid, more preferably the latter. Ricinoleic acid, which is an unsaturated form of 12-hydroxystearic acid, having a double bond in the 9–10 position, can also be used. Other hydroxy fatty acids include 12-hydroxybehenic acid and 10-hydroxypalmitic acid.

The lubricating oil base that is used in preparing the grease compositions of this invention can be any of the conventionally used mineral oils, synthetic hydrocarbon oils, or synthetic ester oils, and will generally have a viscosity within the range of about 35 to 200 SUS at 210° F. Synthetic lubricating oils that can be used include esters of dibasic acids such as di-2-ethylhexyl sebacate, esters of glycols such as the $C_{13}$ oxo acid diester of tetraethylene glycol, or complex esters such as a complex ester formed by reacting 1 mole of sebacic acid with 2 moles of tetraethylene glycol and 2 moles of 2-ethylhexanoic acid. Other synthetic oils that can be used include synthetic hydrocarbons such as alkyl benzenes, e.g., alkylate bottoms from the alkylation of benzene with tetrapropylene, or the copolymers of ethylene and propylene; silicone oils, e.g., ethylphenyl polysiloxanes, methyl polysiloxanes, etc.; polyglycol oils e.g., those obtained by condensing butyl alcohol with propylene oxide; carbonate esters, e.g., the product of reacting $C_8$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups. (See U.S. Pat. No. 3,424,678, column 3.)

The total soap content of the grease composition will be in the range of from about 2 to about 30 weight percent and preferably from about 5 to about 20 weight percent. The hydroxy benzoates of this invention will be incorporated in the grease composition in an amount ranging from about 0.01 to about 10 weight percent, preferably about 0.1 to about 5 weight percent and more preferably about 0.1 to about 1.0 weight percent based on the total weight of the composition. The dioxime compounds will be used in amounts from about 0.01 to about 10 weight percent, preferably from about 0.1 to about 5 weight percent and more preferably about 0.1 to about 2.5 weight percent based on the total weight of the composition.

The grease compositions of this invention can be prepared in accordance with any of the techniques known in the prior art to be useful in the preparation of lithium soap grease compositions. Such methods include, but are not necessarily limited to, those processes wherein the soaps are formed "insitu" by first dissolving or otherwise incorporating the desired acid or acids in a suitable base oil stock and thereafter neutralizing the same with a suitable lithium compound, and those processes wherein the desired soap or soaps are first separately prepared and thereafter dispensed in or otherwise incorporated into the base oil stock.

In addition to the above-defined components, other materials and additives conventionally known and used may be included in the grease composition of this invention. One such material is a lithium soap of $C_2$ to $C_{12}$ aliphatic dicarboxylic acid, e.g., azelaic acid as disclosed in U.S. Pat. Nos. 3,791,973 and 3,929,651 which may be used as part of the thickener system. The proportion of dicarboxylic acid used in this invention will generally be in the range of from about 0.05 to about 2, and preferably from about 0.1 to about 0.8 parts by weight of dicarboxylic acid per part by weight of hydroxy fatty acid.

The following examples as set forth to illustrate the invention and should not be construed as limitations thereof.

EXAMPLE 1

An oil/soap slurry was prepared with a high VI 30 grade Western Canadian paraffinic base oil and 7.8 weight percent lithium 12-hydroxystearate. Bench oxidations tests were run on the slurry (relative lubricant lifetime directly correlates with spindle bearing—NLGI tests on grease). This test consisted of heating the sample to 350° F. (177° C.) in a round bottom flask in a high temperature oil bath, the flask being open to the air and the contents slowly stirred to ensure proper sample/air contact. Samples were withdrawn as a function of time and the extent of oxidation was determined using infrared spectroscopy to measure the carbonyl peak. The values recorded were expressed as absorbence/centimeter (A/cm.) and calibrated against the more common ASTM Total Acid Number (TAN) values. It was shown that 1.0 TAN=12.5 A/cm. The onset of severe oxidation, or induction time, was indicated when the A/cm. value became greater than 12.5 units.

The induction time for the above composition was approximately one hour. Varying amounts of dilithium salicylate (DLS) were added to the same oil/soap slurry and the induction periods for the various DLS concentrations by weight were as follows: 0.25%=5 hours, 0.50%=15 hours, 1.0%=33 hours, 2.5%=105 hours and 5.0%=200 hours.

A 2.5% by weight amount of dimethyl glyoxime was added to the same oil/soap slurry as defined above and the induction period determined by the bench oxidation test was less than 5 hours.

Next, bench oxidations tests were carried out on the soap slurry mentioned above using 1.0 weight percent of dimethyl glyoxime (DMG) and 2.5 weight percent of dilithium salicylate (DLS) and the induction time was 244 hours. The same test with 2.5 weight percent DMG and 2.5 weight percent DLS gave an induction time of 240 hours. The test was run again with 1.0 weight percent DMG and 0.5% DLS and an induction time of 175 hours resulted.

EXAMPLE 2

Bench oxidation tests similar to Example 1 using the same soap slurry as defined in that Example were carried out on a sample containing 2.5 weight percent of dilithium salicylate and 1.0 weight percent of the monolithium salt of dimethyl glyoxime. The induction time was 210 hours. Another sample containing 2.5 weight percent of dilithium salicylate and 1.0 weight percent of the dilithium salt of dimethyl glyoxime also gave an induction time of 210 hours.

EXAMPLE 3

A grease formulation containing 15.5% by weight of a soap comprising lithium 12-hydroxystearate and dilithium azelate was prepared and spindle bearing tests (NLGI-ASTM-D-3336) were carried out on the grease composition at 350° F. (177° C.) using a standard eight component ball bearing (#204). Grease bearing life was the number of hours until failure by overheating or seizure. The bearing life was found to be 20 hours (average of five runs).

The same grease formulation with 2.9 weight percent dilithium salicylate added gave a bearing life of 134 hours (average of three runs). Another sample of the same grease containing 1.0 weight percent of dimethyl glyoxime in addition to the dilithium salicylate gave a bearing life of 240 hours (average of two runs).

It can be seen from the above results that use of the combination of a dioxime compound and a hydroxy benzoic acid metal salt in accordance with the invention as described gives particularly surprising oxidation properties.

What is claimed is:

1. A lubricating grease composition which comprises a major proportion of lubricating oil, from about 2 to about 30 weight percent of a thickener system containing a lithium soap of a $C_{12}$ to $C_{24}$ hydroxy fatty acid and an antioxidant system which comprises from about 0.01 to about 10 weight percent of an alkali metal salt of hydroxy benzoic acid and from about 0.01 to about 10 weight percent of a dioxime compound having the general formula:

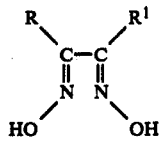

(I)

or

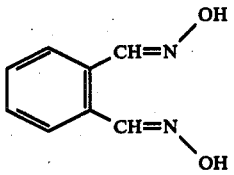

(II)

where R and R′ represent independently selected alkyl groups of 1 to 12 carbon atoms, and alkali metal salts of (I) and (II).

2. The grease composition of claim 1 wherein said hydroxy benzoic acid has the formula:

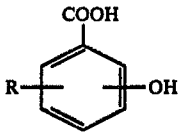

where R is hydrogen or an alkyl group of 1 to 12 carbon atoms and the alkali metal salt of said acid is selected from the group consisting of lithium, sodium and potassium.

3. The grease composition of claim 1 wherein the alkali metal salt of said dioxime compound is used.

4. The grease composition of claim 3 wherein said alkali metal salt of dioxime is the lithium salt.

5. The grease composition of claim 2 wherein said dioxime compound is the dialkylglyoxime of formula I where R and R′ represent independently selected alkyl groups of 1 to 4 carbon atoms.

6. The grease composition of claim 5 wherein from about 0.1 to about 5 weight percent of each component in said antioxidant system is used.

7. The grease composition of claim 6 wherein said alkali metal salt of hydroxy benzoic acid is the lithium salt of the ortho hydroxy acid and said R group is hydrogen or an alkyl group of 1 to 4 carbon atoms.

8. The grease composition of claim 7 wherein the alkali metal salt of said dioxime compound is used.

9. The grease composition of claim 8 wherein said alkali metal salt of dioxime is the lithium salt.

10. The grease composition of claim 7 wherein said dioxime compound is dimethylglyoxime.

11. The grease composition of claim 10 wherein said alkali metal salt of hydroxy benzoic acid is dilithium salicylate.

12. The grease composition of claim 11 wherein the lithium soap of hydroxy fatty acid has from 16 to 20 carbon atoms.

13. The grease composition of claim 12 wherein said hydroxy fatty acid is 9-hydroxy, 10-hydroxy or 12-hydroxystearic acid.

14. The grease composition of claim 13 wherein said thickener system additionally contains a lithium soap of $C_2$ to $C_{12}$ aliphatic dicarboxylic acid.

* * * * *